US007287289B1

(12) United States Patent
Hagopian

(10) Patent No.: US 7,287,289 B1
(45) Date of Patent: Oct. 30, 2007

(54) SURGICAL TABLE HAVING LOW PRESSURE ANTI DECUBITUS ULCER SURFACE

(76) Inventor: Mark Hagopian, 418 St. Andrew Dr., Belleair, FL (US) 34616

( * ) Notice: Subject to any disclaimer, the term of this patent is extended or adjusted under 35 U.S.C. 154(b) by 0 days.

(21) Appl. No.: 11/163,843

(22) Filed: Nov. 1, 2005

(51) Int. Cl.
*A47B 71/00* (2006.01)

(52) U.S. Cl. ..... 5/600; 5/691; 5/710; 5/713; 5/922

(58) Field of Classification Search ..... 5/710, 5/706, 600, 691, 922, 655.3, 713
See application file for complete search history.

(56) References Cited

U.S. PATENT DOCUMENTS 5,963,997 A * 10/1999 Hagopian ..... 5/654
6,014,783 A * 1/2000 Collier et al. ..... 5/618
6,401,283 B2 * 6/2002 Thomas et al. ..... 5/740
6,484,334 B1 * 11/2002 Borders et al. ..... 5/600
6,578,219 B1 * 6/2003 Gabel et al. ..... 5/710
6,678,908 B2 * 1/2004 Borders et al. ..... 5/691

* cited by examiner

*Primary Examiner*—Alexander Grosz
(74) *Attorney, Agent, or Firm*—Ronald E. Smith; Smith & Hopen, P.A.

(57) ABSTRACT

Patient support pads that form a part of conventional surgical tables are removed and replaced with pads that provide three dimensional volumetric pressure redistribution. The pads are releasably secured in overlying relation to conventional frame cushions that overlie the frame of a surgical table. Three pads are provided, one each for the head, torso, and foot section of the table so that the articulation of the table is not compromised by the pads. The pads not only prevent or inhibit the formation of decubitus ulcers during surgery but also provide therapeutic, curative treatment of the patient's dermis and epidermis by redistributing pressure without distorting or compressing soft tissue. A dual hose bifurcated manifold system connects each inflated pad to its contiguous inflated pad so that pressure applied in any one section of the surface is transmitted and redistributed over all of the inflated pads.

4 Claims, 3 Drawing Sheets

SURGICAL TABLE HAVING LOW PRESSURE ANTI DECUBITUS ULCER SURFACE

DESCRIPTION

1. Field of the Invention

This invention relates, generally, to support surfaces that are designed to prevent or inhibit the formation of decubitus ulcers, bedsores or pressure sores. More particularly, it relates to a support surface that is retrofit onto a conventional surgical table.

2. Description of the Prior Art

Studies have shown that pressure sores develop in 2.7 to 29% of all patients in the general acute population of a hospital. Perhaps more surprisingly, 12 to 66% of operating room patients acquire such sores. The studies have also shown that pressure sore development may take several days in a nursing home or other patient care facility, but only a few hours on a surgical table.

The reason for this discrepancy is that conventional surgical tables and the environment of the surgery suite place more stress on a patient's dermis and subcutaneous tissue. Placing a patient under anesthesia substantially reduces peripheral circulation and lowers the metabolic rate of soft tissue. Cooling pads are often used to retard tissue metabolic activity of the anesthetized patient, thereby further adversely affecting the patient's circulation. Moreover, pharmaceutical agents may be employed during surgery that induce hypotension diminishing peripheral blood flow. All of these factors bias the patient toward the development of pressure sores.

Surgical tables are typically quite hard and the inability to reposition a patient with poor circulation, coupled with the aforementioned causes, often is the cause of serious pressure sores. The resulting mechanical soft tissue tensile stress accelerates the cascading process of subcutaneous soft tissue infarcation that leads to pressure sores.

There are three (3) well-known approaches to minimize the formation of pressure sores: 1) alternating pressure surfaces; 2) static pressure redistribution surfaces; and 3) dynamic pressure distribution surfaces.

An alternating pressure surface device includes a plurality of inflation sacs that support a patient's body. About half of the patient's body is supported by a first plurality of fully inflated inflation sacs and the other half of the patient's body is in contact with a second plurality of uninflated inflation sacs. After the passage of a predetermined amount of time, such as five (5) minutes, the first plurality of inflation sacs deflates and the second plurality of inflation sacs inflates. In this way, no part of the patient's body is in contact with an inflated inflation sac for an uninterrupted period of time longer than the preselected time.

Unfortunately, alternating pressure surfaces rely on the principle of reactive hyperemia. Whereby, high pressure applied to the dermis from an inflated air sac creates a buildup or damming effect of blood (hyperemic reserve). Once the inflate air sac is deflated blood begins to rush into the tissue which was previously not under pressure as a compensatory response to the hypoxic tissue. The tissue in the area not served by the occluded blood or low pressure zone is at all times hypoxic. When the inflated air sac causing the occlusions begins to deflate at the expiration of said predetermined amount of time, blood and the oxygen it carries rush into the hypoxic tissue.

As blood rushes into the hypoxic tissue, the sudden reperfusion can injure the blood vessel walls of the patient.

Moreover, the reperfusion does not always fully restore the blood flow. Due to the compromised hypotensive nature of the anesthetized circulatory system and the lack of a sufficient hyperemic reserve, the reperfusion may not fully restore the hypoxic tissue to its pre-hypoxic state. Accordingly, the health of the tissue subjected to repeated rounds of occlusion and reperfusion steadily deteriorates. Clinical studies have shown that the frequency of mechanically induced blood flow turbulence from alternating pressure results in the disruption of normal laminar flow patterns of blood cells, is directly related to the level of reperfusion injury, and may be more injurious than constant pressure per se.

If pre-surgery diagnosis of the homodynamic profiles of a patient indicates that said patient has a lack of hyperemic reserve due to intrinsic factor such as peripheral vascular disease pre anesthesia induced hypotension, an alternating pressure surface is unsuitable for such a patient.

As well most geriatric patients have circulatory systems that are compromised by vascular diseases such as arteriosclerosis, peripheral vascular disease related to diabetes mellitus, or by anesthesia-induced hypotension. Both the dermis and the epidermis become thinner with the passage of time and the elasticity of the skin decreases. Collagen synthesis also declines. The skin loses tensile strength and moisture. All these factors make the skin stiffer and decrease its ability to withstand mechanical trauma from alternating pressure surfaces, thereby making the skin more susceptible to ulcer development.

Mechanical forces caused by alternating pressure air cells also produce high levels of vertical shear. Specifically, alternating pressure surfaces greatly amplify vertical shear which leads to crimping and elongation (tensile stress) of soft tissue and microcirculation.

Most surgeons dislike alternating pressure surface systems because the patient moves several inches in a vertical plane every few minutes as the inflation sacs are inflated and deflated in accordance with their times inflation and deflation cycle. Such instability is even more unacceptable in the field of a surgical microscope.

Static pressure redistribution surfaces are provided in the form of gel pads and visco elastic foam overlays. Such devices are in common use in hospitals but are perceived as providing substandard care in most nursing homes. This is the opposite of what would be expected since operating theaters, as discussed above, are more conducive to the formation of pressure sores.

The third well-known therapy device for wound care provides dynamic pressure redistribution surfaces. Instead of alternately supporting half of the patient's body for predetermined time periods as in the alternating pressure surface devices, these surfaces redistribute pressure and shear forces evenly over the supporting surface of the device. This creates an environment conducive to peripheral blood flow while minimizing perpendicular gradient pressures that may cause mechanical deformation of soft tissue. However, the successful support of the patient's body depends upon the ability of the system to conform to the anthropometric characteristics of the body in suspension.

More particularly, to achieve optimal pressure and vertical shear relief in operating room conditions, a full table pad system is required to maximize surface area for redistribution of pressure and minimizing vertical shear. This is supplied as an overlay on top of the existing surgical table pads or cushions. However, the lack of advanced air pump controller technology dictates that the surface be large, engaging the entire surface of the surgical table as an overlay increasing the height of the surface. As in the alternating pressure devices, the surface is unstable. Moreover, the elongate pad inhibits the articulation of the surgical table. Moreover, since the pad is placed atop the pre-existing cushions, the additional layer of solid material increases absorption of X-rays, thereby producing cloudy images during intra operative radiography.

What is needed, then, is an apparatus for use with surgical tables that enables a patient to come out of surgery free of pressure sores. The needed device would not adversely affect the articulation of a surgical table, nor would it affect the radiolucent properties of the surgical table. The needed device would also be stable, holding the patient against movement.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an improved surgical table for reducing the incidence of pressure sores for patients undergoing surgery is now met by a new, useful, and non-obvious invention.

The novel surgical table includes an articulated frame including a head, middle, and foot section. A first frame cushion is secured in overlying relation to the head frame section, a second frame cushion is secured in overlying relation to the middle frame section, and a third frame cushion is secured in overlying relation to the foot frame section. A first inflated pad is releasably secured in overlying relation to the first frame cushion, a second inflated pad is releasably secure in overlying relation to the second frame cushion, and a third inflated pad is releasably secured in overlying relation to the third frame cushion.

The middle section of the surgical table further includes a left arm frame section and a right arm frame section, covered by a left arm frame cushion and a right arm frame cushion, respectively. A fourth inflated pad is releasably secured in overlying relation to the left arm frame cushion, also referred to herein as the fourth frame cushion, and a fifth inflated pad is releasably secured in overlying relation to the right arm frame cushion, also referred to herein as the fifth frame cushion.

The first, second, third, fourth and fifth inflated pads provide three dimensional volumetric pressure redistribution. Each inflated pad conforms to anatomical characteristics of a patient disposed in overlying relation to the inflated pads. Accordingly, the patient is suspended in non-contacting relation to the first, second, third, fourth and fifth frame cushions so that pressure is distributed throughout parts of the patient's body that are in contact with the first, second, third, fourth, and fifth inflated pads. The soft tissue of the patient is therefore neither compressed nor distorted.

A first releasble fastening means is secured to a top surface of the first frame cushion, a second releasable fastening means secured to a top surface of the second frame cushion, a third releasable fastening means is secured to a top surface of the third frame cushion, a fourth releasable fastening means is secured to a top surface of the fourth frame cushion, and a fifth releasable fastening means is secured to a top surface of the fifth frame cushion.

A first releasable fastening means is secured to a bottom surface of the first inflated pad, a second releasable fastening means is secured to a bottom surface of the second inflated pad, a third releasable fastening means is secured to a bottom surface of the third inflated pad, a fourth releasable fastening means is secured to a bottom surface of the fourth inflated pad, and a fifth releasable fastening means is secured to a bottom surface of the fifth inflated pad.

The first inflated pad is disposed in overlying relation to the first frame cushion and the first releasable fastening means of the first frame cushion is releasably engaged to the first fastening means of the first inflated pad. The second inflated pad is disposed in overlying relation to the second frame cushion and the second releasable fastening means of the second frame cushion is releasably engaged to the second fastening means of the second inflated pad. The third inflated pad is disposed in overlying relation to the third frame cushion and the third releasable fastening means of the third frame cushion is releasably engaged to the third fastening means of the third inflated pad. The fourth inflated pad is disposed in overlying relation to the fourth frame cushion and the fourth releasable fastening means of the fourth frame cushion is releasably engaged to the fourth fastening means of the fourth inflated pad. The fifth inflated pad is disposed in overlying relation to the fifth frame cushion and the fifth releasable fastening means of the fifth frame cushion is releasably engaged to the fifth fastening means of the fifth inflated pad.

Each inflated pad is connected to its contiguous inflated pad or pads with a dual hose bifurcated manifold system. Pressure applied in any one section of the surface is therefore transmitted and redistributed over the entire system through a controller unit disclosed in U.S. Pat. No. 5,963,997 to the present inventor. Said U.S. Pat. No. 5,963,997 is hereby incorporated by reference in its entirety into this disclosure.

Advantageously, substitution of the first, second, third, fourth and fifth support cushions that overlie the first, second, third, fourth and fifth frame cushions, respectively, of a conventional surgical table, by said first, second, third, fourth, and fifth inflated pads, respectively, does not adversely affect the radiolucent properties of the surgical table. The articulation of the surgical table is also unimpeded by the substitution. Most importantly, the first, second, third, fourth and fifth pads provide three dimensional volumetric pressure redistribution, thereby preventing the formation of pressure sores. The patient is cradled in a stable position. The normal orientation of the patient's subcutaneous tissue, muscle, and bone is maintained. Additionally, bony prominences do not impale muscle and subcutaneous tissue.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
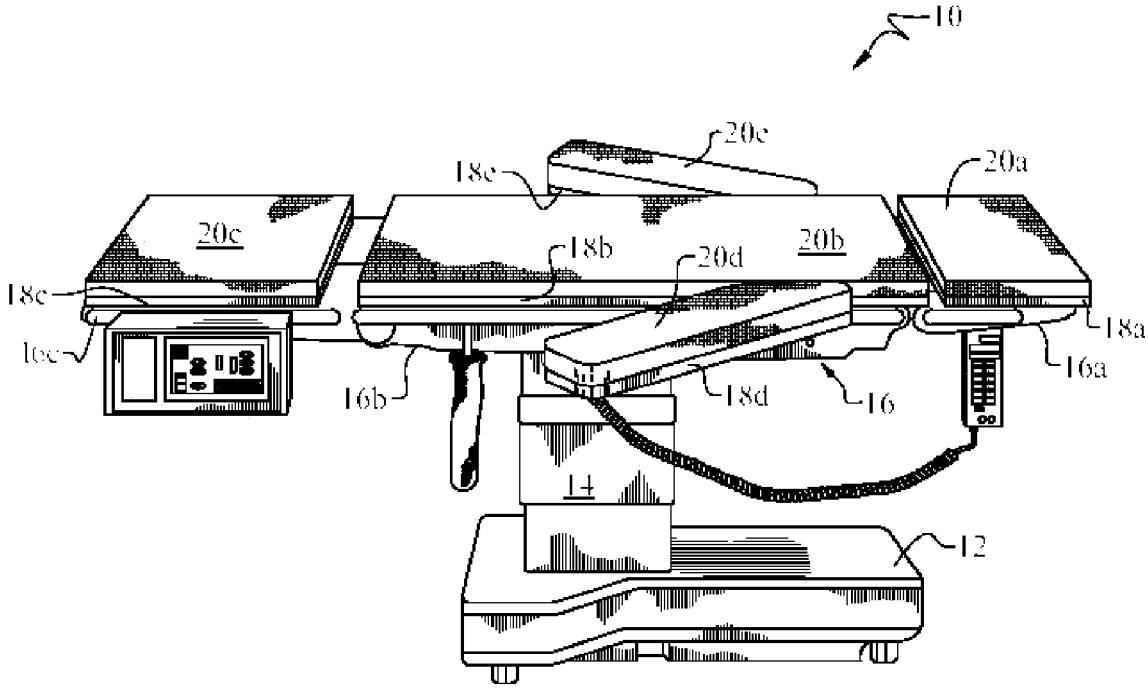
FIG. 1 (PRIOR ART)
FIG. 1 is a perspective view of a prior art surgical table.
Figure 2:
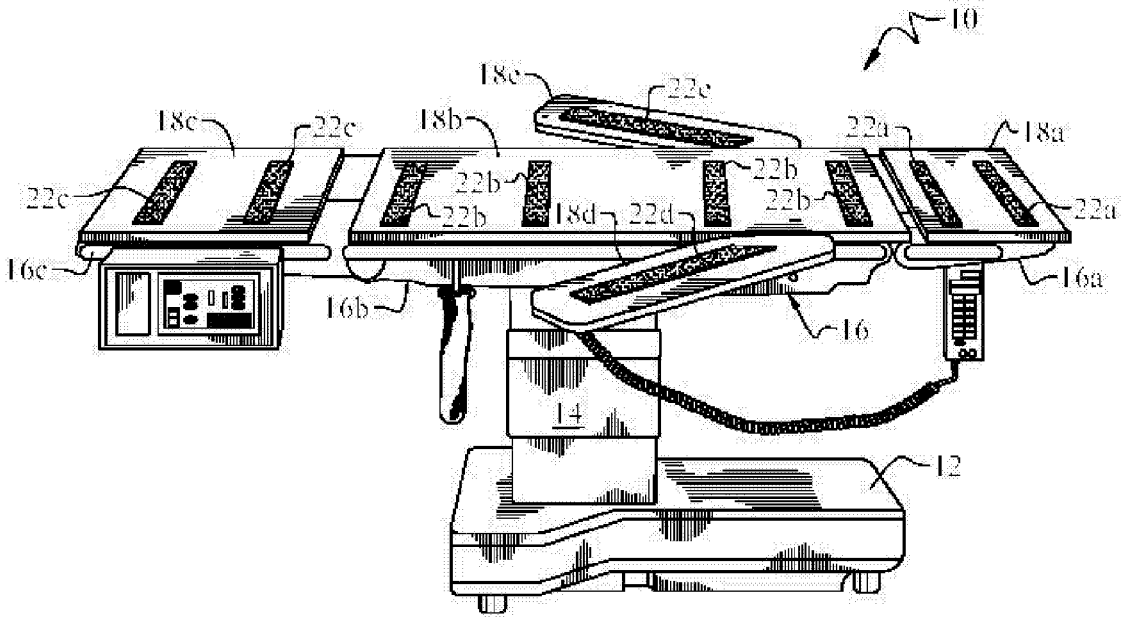
FIG. 2 is a view like that of FIG. 1 but with the pads of the prior art surgical table removed therefrom and with the novel hook and loop fasteners added to said prior art table.

Referring now to FIGS. 1 and 2, it will there be seen that a prior art surgical table is denoted as a whole by the reference numeral 10. Surgical table 10 includes base 12, pedestal 14, and articulated frame 16 that includes head frame section 16*a*, trunk frame section 16*b*, and foot frame section 16*c*. These frame sections are hingedly connected to one another in a well-known way so that the patient may be positioned in differing positions.

Frame cushions or pads 18*a*, 18*b*, and 18*c* overlie frame sections 16*a*, 16*b*, and 16*c*, respectively. Left and right arm pads 18*d*, 18*e* are cantilevered with respect to frame section 16*b* and overlie left arm frame section 16*d* and right arm frame section 16*e*, respectively.

Support pads 20*a*, 20*b*, 20*c*, 20*d*, and 20*e* overlie frame pads 18*a*, 18*b*, 18*c*, 18*d*, and 18*e*, respectively. As depicted in FIG. 2, hook and loop fasteners 22*a*, 22*b*, 22*c*, 22*d*, and 22*e* are respectively secured to the exposed top surfaces of each of said frame pads. Fasteners 22*a*, 22*b*, 22*c*, 22*d*, and 22*e* are releasably engaged by mating hook and loop fasteners, not depicted, on the underside of each support cushion 20*a*, 20*b*, 20*c*, 20*d*, and 20*e*.

The novel apparatus has an articulated construction and is attached to the head, middle, foot and arm sections of a surgical table. It supplies therapeutic pressure relief and vertical shear reduction.

Figure 3:
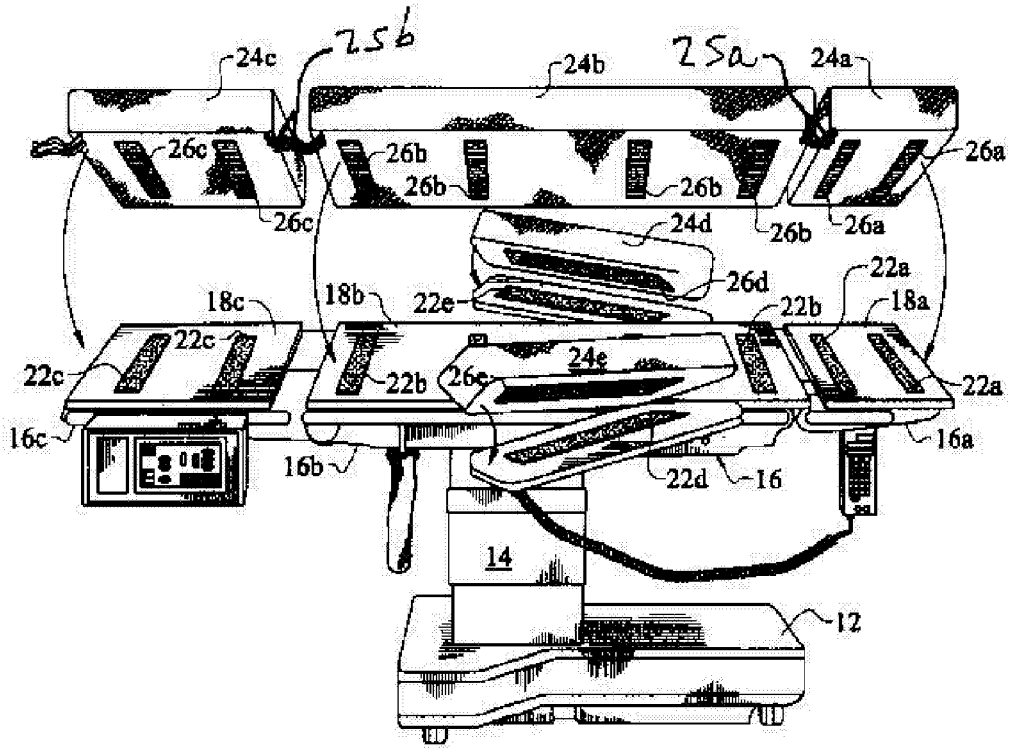
FIG. 3 is an exploded perspective view of the novel surgical table.
Figure 4:
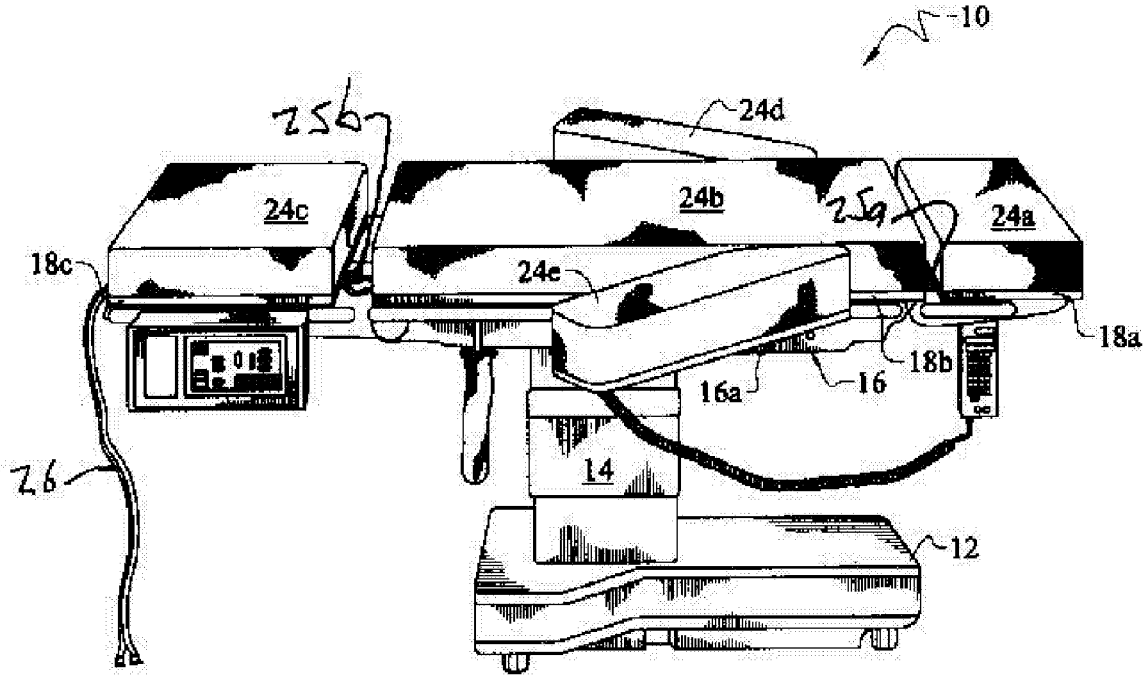
FIG. 4 is a view like that of FIG. 1 but with the novel pads substituted for the prior art pads.

Support cushions 20*a*, 20*b*, 20*c*, 20*d*, and 20*e* that are provided by the manufacturer of surgical table 10 are discarded or recycled, and novel inflated pads 24*a*, 24*b*, 24*c*, 24*e*, and 24*d* are substituted therefore as best understood in connection with FIGS. 3 and 4. The novel inflated pads are fully integrated with surgical table 10, just as if they had been manufactured as original equipment. In a preferred embodiment, hook and loop fasteners 26*a*, 26*b*, 26*c*, 26*d*, and 26*e* are secured to the respective undersides of inflated pads 24*a*, 24*b*, 24*c*, 24*d*, and 24*e* and said hook and loop fasteners mate with their counterpart hook and loop fasteners 22*a*, 22*b*, 22*c*, 22*d*, and 22*e* in the well-known way. When cleaning is required, inflated pads 24*a*, 24*b*, 24*c*, 24*d*, and 24*e* are easily detached from frame pads 18*a*, 18*b*, 18*c*, 18*d*, and 18*e*, respectively, and easily re-attached after the cleaning has been performed.

The novel inflated pads do not overlie prior art support pads 20*a*, 20*b*, 20*c*, 20*d*, and 20*e*. The radiolucent qualities of the structure are therefore undiminished.

Significantly, the novel pads are therapeutic or curative and are not just preventative.

The dynamic air suspension system that provides the ideal amount of pressure for all body contact points is disclosed in U.S. Pat. No. 5,963,997 to the present inventor. That patent is hereby incorporated by reference into this disclosure.

The novel pads are articulated in the same locations as the articulations of the surgical table and can be custom fit to tables having unusual geometries or having unusual articulation locations. Accordingly, stability is not compromised because the three dimensional effect of the cradling of the table is translated to the novel apparatus.

Each inflated pad is connected to its contiguous inflated pad or pads with a dual hose bifurcated manifold system. Pressure applied in any one section of the surface is therefore transmitted and redistributed over the entire system through a controller unit disclosed in said U.S. Pat. No. 5,963,997 to the present inventor.

In FIGS. 3 and 4, the hoses that interconnect inflated pads 24*a* and 24*b* are collectively denoted 25*a* and the hoses that interconnect inflated pads 24*b* and 24*c* are collectively denoted 25*b*. The joints where contiguous hoses are connected to one another are depicted as small boxes but not numbered to avoid cluttering the drawings. Elongate hose 26 in FIG. 4 is connected to a source of compressed air as more fully explained in the incorporated patent.

The novel pads incorporate a dynamic air suspension system with active feedback pressure-sensing and correction capability. Interface pressures measured by third party test facilities confirms that novel pad system 10 reduces pressure consistently below thirty two millimeters of mercury (32 mm Hg) in seated individuals. The pressures are much lower for supine individuals because of the much larger area over which the weight of the individual is spread.

CT scans confirm that the surface of novel pad system 10 maintains normal symmetry of soft tissue as well as substantially decreasing the compression of said soft tissue into ischeal tuberositiies and other bony prmoinences.

Specifically, the average measured increase in distance from the dermis to the most posterior point of the ischeal tuberosity is twenty-seven millimeters of mercury (27 mm Hg) in the supine position greater than any other surface tested.

The novel apparatus may be operated under internal battery power when being transported.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A surgical table, comprising:

an articulated frame including a head, middle, and foot section;

a first frame cushion secured in overlying relation to said head section;

a second frame cushion secured in overlying relation to said middle section;

a third frame cushion secured in overlying relation to said foot section;

a first inflated pad releasably secured in overlying relation to said first frame cushion;

a second inflated pad releasably secured in overlying relation to said second frame cushion;

a third inflated pad releasably secured in overlying relation to said third frame cushion;

a manifold system connecting said first inflated pad to said second inflated pad and said second inflated pad to said third inflated pad;

a controller unit that transmits and redistributes pressure that exceeds capillary occlusion pressure applied to any location on any of said first, second, and third inflated pads throughout said first, second and third inflated pads so that said pressure is distributed throughout parts of a patient's body in contact with said first, second and third inflated pads whereby soft tissue of the patient is neither compressed nor distorted;

a pressure transducer for frequently sampling an actual internal air pressure in each inflated pad, said pressure transducer sending a signal to a comparator means that compares the pressure transducer signal to a preset preprogrammed pressure profile for a particular patient;

said comparator means adapted to open vents formed in an inflated pad if the detected actual internal air pressure exceeds the pressure profile for that patient;

said comparator means adapted to turn on a pump to add pressure to an inflated pad if the detected actual internal air pressure is below the pressure profile for the patient;

said first, second third inflated pads providing three dimensional volumetric pressure redistribution, thereby conforming to anatomical characteristics of the patient disposed in overlying relation to said first, second, and third frame cushions and suspending the patient in non-contacting relation to said first, second, and third frame cushions.

2. The surgical table of claim 1, further comprising:

a first releasable fastening means secured to a top surface of said first frame cushion;

a second releasable fastening means secured to a top surface of said second frame cushion;

a third releasable fastening means secured to a top surface of said third frame cushion;

a first releasable fastening means secured to a bottom surface of said first inflated pad;

a second releasable fastening means secured to a bottom surface of said second inflated pad;

a third releasable fastening means secured to a bottom surface of said third inflated pad;

said inflated first pad disposed in overlying relation to said first frame cushion and said first releasable fastening means of said first frame cushion being releasably engaged to said first fastening means of said first inflated pad;

said second inflated pad disposed in overlying relation to said second frame cushion and said second releasable fastening means of said second frame cushion being releasably engaged to said second fastening means of said second inflated pad;

said third inflated pad disposed in overlying relation to said third frame cushion and said third releasable fastening means of said third frame cushion being releasably engaged to said third fastening means of said third inflated pad;

whereby substitution of said first, second, and third support cushions that overlies said first, second, and third frame cushions, respectively, of a conventional surgical table, by said first, second, and third inflated pads, respectively, does not adversely affect the radiolucent properties of the surgical table.

3. The surgical table of claim 1, further comprising:

said surgical table middle section including a left arm frame disposed in cantilevered relation to a left side of said middle section and a right arm frame disposed in cantilevered relation to a right side of said middle section;

a fourth frame cushion secured in overlying relation to said left arm frame;

a fifth frame cushion secured in overlying relation to said right arm frame;

a fourth inflated pad releasably secured in overlying relation to said fourth frame cushion;

a fifth inflated pad releasably secured in overlying relation to said fifth frame cushion;

said fourth and fifth inflated pads providing three dimensional volumetric pressure redistribution, thereby conforming to anatomical characteristics of a patient's arms disposed in overlying relation to said fourth and fifth inflated pads and suspending said arms in non-contacting relation to said fourth and fifth frame cushions so that pressure is distributed throughout parts of the patient's arms in contact with said fourth and fifth inflated pads, so that soft tissue of the patient is neither compressed nor distorted.

4. The surgical table of claim 3, further comprising:

a first releasable fastening means secured to a top surface of said fourth frame cushion;

a second releasable fastening means secured to a top surface said of fifth frame cushion;

a first releasable fastening means secured to a bottom surface of said fourth inflated pad;

a second releasable fastening means secured to a bottom surface of said fifth inflated pad;

said fourth inflated pad disposed in overlying relation to said fourth frame cushion and said first releasable fastening means of said fourth frame cushion being releasably engaged to said first fastening means of said fourth inflated pad;

said fifth inflated pad disposed in overlying relation to said fifth frame cushion and said second releasable fastening means of said fifth frame cushion being releasably engaged to said second fastening means of said fifth inflated pad;

whereby substitution of fourth and fifth support cushions that overlie said fourth and fifth frame cushions, respectively, of a conventional surgical table, by said fourth and fifth pads, respectively, does not adversely affect the radiolucent properties of the surgical table.

* * * * *